US007648215B2

(12) United States Patent
Song et al.

(10) Patent No.: US 7,648,215 B2
(45) Date of Patent: Jan. 19, 2010

(54) INK-JET HEAD MOUNT AND INK-JET PRINTING APPARATUS USING THE SAME

(75) Inventors: Se Kyong Song, Seoul (KR); Ki Keon Yeom, Suwon-si (KR); Jae Rack Choi, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 492 days.

(21) Appl. No.: 11/178,287

(22) Filed: Jul. 12, 2005

(65) Prior Publication Data

US 2006/0077225 A1 Apr. 13, 2006

(30) Foreign Application Priority Data

Oct. 7, 2004 (KR) ..... 10-2004-0080048

(51) Int. Cl.
*B41J 25/308* (2006.01)

(52) U.S. Cl. ..... 347/8

(58) Field of Classification Search ..... 347/8, 347/40, 43, 49

See application file for complete search history.

(56) References Cited

U.S. PATENT DOCUMENTS 6,076,915 A * 6/2000 Gast et al. ..... 347/19
6,213,580 B1 4/2001 Segerstrom et al.
6,565,206 B2 5/2003 Okabe et al.
6,575,557 B2 * 6/2003 Tominaga ..... 347/37
6,758,550 B2 * 7/2004 Ito et al. ..... 347/40
6,796,630 B2 * 9/2004 Ison et al. ..... 347/18

FOREIGN PATENT DOCUMENTS

| | | | |
|---|---|---|---|
| JP | 08197721 | * | 8/1996 |
| JP | 411277734 A | * | 10/1999 |
| JP | 2001301148 | * | 10/2001 |
| JP | 2002-264311 | | 9/2002 |
| JP | 2003-139934 | | 5/2003 |
| JP | 2004-31070 | | 1/2004 |
| KR | 2002-87676 A | | 11/2002 |
| KR | 2003-80378 A | | 10/2003 |

* cited by examiner

*Primary Examiner*—Anh T. N. Vo
(74) *Attorney, Agent, or Firm*—Stanzione & Kim LLP

(57) ABSTRACT

An ink-jet head mount to guide positions of ink-jet heads with a high precision and an ink-jet printing apparatus including the same. The ink-jet printing apparatus includes an ink-jet head having a plurality of nozzles to eject ink, an ink-jet head mount in which the ink-jet head is installed and is movable according to three-degrees-of-freedom, and a frame in which the ink-jet head mount is installed.

16 Claims, 7 Drawing Sheets

INK-JET HEAD MOUNT AND INK-JET PRINTING APPARATUS USING THE SAME

CROSS-REFERENCE TO RELATED APPLICATIONS

This application claims the benefit of Korean Patent Application No. 2004-80048, filed on Oct. 7, 2004 in the Korean Intellectual Property Office, the disclosure of which is incorporated herein in its entirety by reference.

BACKGROUND OF THE INVENTION

1. Field of the Invention

The present general inventive concept relates to an ink-jet head mount and an ink-jet printing apparatus using the same, and more particularly to an ink-jet head mount to minutely adjust a position of an ink-jet head to eject red ink, green ink, and blue ink on a glass panel in an ink-jet printing system to manufacture a color filter for a liquid crystal display (LCD).

2. Description of the Related Art

An ink-jet printing method is used to manufacture a color filter used in thin film transistor-liquid crystal displays (TFT-LCD). A glass panel having a pixel matrix to form the color filter is printed on by a piezo-driven ink-jet head having a plurality of nozzles to eject the ink onto the pixel matrix. The ink on the pixel matrix is then hardened to form a color filter layer. In comparison to conventional photolithography methods, this ink-jet printing method can remarkably reduce materials used in manufacturing the color filter and can reduce a number of processing steps.

Conventional ink-jet printing apparatuses used in the ink-jet printing method are disclosed in U.S. Pat. No. 6,565,206 and Japanese Patent Laid-Open No. 2003-048312. U.S. Pat. No. 6,565,206, discloses an ink-jet printing apparatus including a single head unit in which three ink-jet heads for red color, green color, and blue color are provided. Each ink-jet head is installed to rotate in a θ direction and to linearly move in a B-direction. In other words, each ink-jet head is installed to move with two-degrees-of-freedom. As such, positions of the ink-jet heads are adjusted to arrange the ink-jet heads on the pixel matrix. Japanese Patent Laid-Open No. 2003-048312 discloses an ink-jet printing apparatus including a plurality of ink-jet heads, wherein each ink-jet head is installed to perform the two-degree-of-freedom movement in a single directional rotating movement and a single directional linear motion.

In an ink-jet printing apparatus for manufacturing a color filter using three color ink-jet heads, that is, red (R), green (G), and blue (B) color ink-jet heads, a device for minutely adjusting respective ink-jet heads is required to equalize a nozzle pitch NP between nozzles formed in lower surfaces of respective ink-jet heads with a pixel pitch PP between lattices on the pixel matrix.

When a high resolution pixel matrix is used (generally, less than a few μm), it is more difficult to precisely adjust the nozzle pitch NP, the pixel pitch PP, and positions of the ink-jet heads. As a result, ink ejected from the ink-jet heads may not be precisely coated within a desired pixel cavity of the pixel matrix for the color filter and some portion thereof may be coated outside of the desired pixel cavity. This may lead to an increase in a number of inferior color filters manufactured.

Glass panels of the TFT-LCD are manufactured in a variety of models according to user demand, and the pixel pitch PP is different according to the various models. Thus, the ink-jet heads must be arranged to correspond to the pixel pitch PP of respective models. In the conventional ink-jet printing apparatuses, since the respective ink-jet heads rotate and linearly move, the positions of the heads can be adjusted according to the pixel pitch PP of the glass panels used to manufacture the color filter.

However, the conventional ink-jet heads move according to only two-degrees-of-freedom, so that there is a limit to the precision with which the position of the ink jet heads may be adjusted.

Moreover, since the positions of the conventional ink-jet heads are minutely adjusted by a plurality of mechanical components, driving errors, such as friction between the mechanical components, backlash, pitching, yawing, rolling, or the like, are inevitable, so that the positions of the ink-jet heads cannot be precisely adjusted.

SUMMARY OF THE INVENTION

The present general inventive concept provides an ink-jet head mount to guide positions of ink-jet heads with a high precision of less than a few μm and an ink-jet printing apparatus including the same.

The present general inventive concept also provides an ink-jet head mount to precisely adjust positions of ink-jet heads by removing driving errors that occur between mechanical components when adjusting the positions of the ink-jet heads and an ink-jet printing apparatus including the same.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept may be achieved by providing an ink-jet printing apparatus, including an ink-jet head having a plurality of nozzles to eject ink, an ink-jet head mount in which the ink-jet head is installed to be movable according to three-degrees-of-freedom, and a frame in which the ink-jet head mount is installed.

The ink-jet head mount can further include a body fixed to the frame, a head installer disposed in the body to be minutely movable with respect to the body and in which the ink-jet head is installed, and an elastic deformation part to apply a restoring force to the head installer when the head installer is moved.

Moreover, the body surrounds the head installer, and the ink-jet head mount can further include a gap to separate the head installer from the body and formed around the head installer so as to secure the minute movement of the head installer.

The elastic deformation part can comprise a plate spring to connect the head installer to the body.

The body, the head installer, and the elastic deformation part can be integrally formed with each other.

The ink-jet head mount can comprise a position adjustor to minutely adjust a position of the head installer.

Moreover, the position adjustor can include a first position adjustor to move the head installer in a lengthwise direction, and a second position adjustor and a third position adjustor provided at both ends of the head installer to move the respective ends of the head installer in a widthwise direction of the head installer.

The ink-jet printing apparatus can further include a driving part to move the frame about a print substrate.

The foregoing and/or other aspects and advantages of the present general inventive concept may also be achieved by providing an ink-jet printing apparatus including a plurality of inkjet heads having a plurality of nozzles to eject ink, an ink-jet head mount in which the plurality of ink-jet heads are installed such that one of the plurality of ink-jet heads is set as a reference ink-jet head, and relative positions of remaining ink-jet heads are adjustable with respect to the reference ink-jet head, and a frame in which the ink-jet head mount is installed. Intervals between the plurality of ink-jet heads may also be adjustable.

The remaining ink-jet heads can be moved according to three-degrees-of-freedom.

The foregoing and/or other aspects and advantages of the present general inventive concept may also be achieved by providing an ink-jet printing apparatus including a first ink-jet head, a second ink-jet head, and a third ink-jet head to eject red colored ink, green colored ink, and blue colored ink without overlapping, an ink-jet head mount in which two ink-jet heads are installed to be minutely controlled according to three-degrees-of-freedom with respect to one ink-jet head as a reference point among the first, second, and third ink-jet heads, a frame in which the ink-jet head mount is installed, and a driving part to move the frame about a print substrate.

The first, second, and third ink-jet heads can be installed in parallel, and the first and third ink-jet heads can be installed in the ink-jet head mount on opposite sides of the second ink-jet head to be movable with respect to the second ink-jet head.

The ink-jet head mount can include a first ink-jet head installer, a second ink-jet head installer, and a third ink-jet head installer in which the first, second, and third ink-jet heads are respectively installed, and a body to surround the first, second, and third ink-jet head installers.

A gap can be formed around the first and third ink-jet head installers so as to separate the first and third ink-jet head installers from the body by a predetermined distance.

The ink-jet head mount can include an elastic deformation part to connect the first ink-jet head installer and the third ink-jet head installer to the body and to generate a restoring force when the first and third ink-jet heads are minutely moved.

The elastic deformation part can include a plate spring.

The elastic deformation part can be provided around corners of the first and third ink-jet head installers.

The first, second, and third ink-jet head installers, the body, and the elastic deformation part can be integrally formed with each other.

Moreover, the ink-jet head mount can include a first position adjustor to move the first ink-jet head installer in a lengthwise direction thereof, a second position adjustor and a third position adjustor to move both ends of the first inkjet head installer in a widthwise direction of the first ink-jet head installer, a fourth position adjustor to move the third ink-jet head installer in a lengthwise direction thereof, and a fifth position adjustor and a sixth position adjustor to move both ends of the third ink-jet head installer in a widthwise direction of the third ink-jet head installer.

The driving part can rotate and linearly move the frame in one or more directions about the print substrate.

The foregoing and/or other aspects and advantages of the present general inventive concept may also be achieved by providing an ink-jet printing apparatus including an ink-jet head installer in which an ink-jet head is installed, a body spaced apart from the ink-jet head such that the ink-jet head installer is minutely movable within the body, and an elastic deformation part to connect the ink-jet head installer to the body and to generate a restoring force when the ink-jet head installer is moved.

The ink-jet head installer can be integrally formed with the body and the elastic deformation part.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
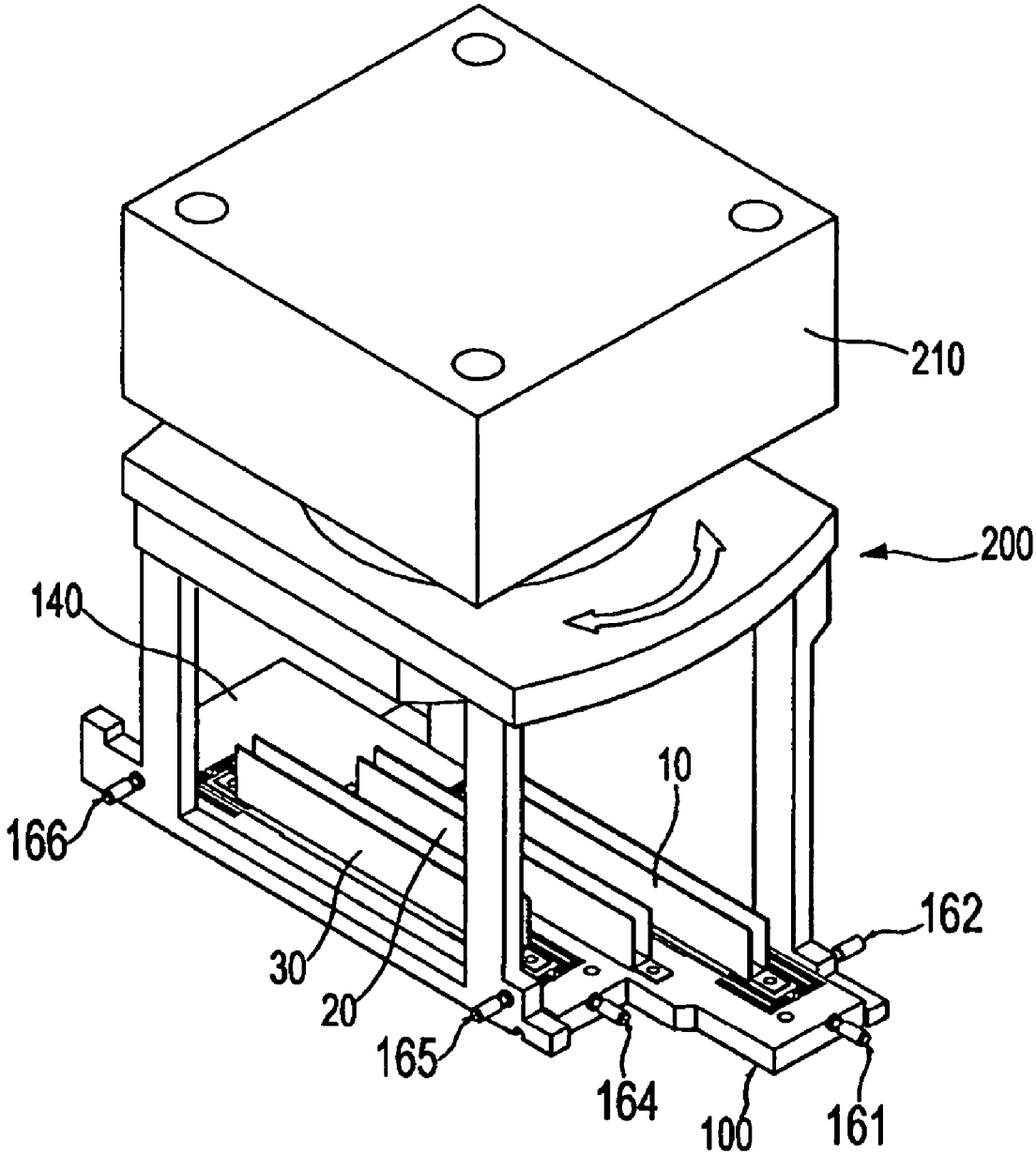
FIG. 1 is a perspective view illustrating an ink-jet printing apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

An ink-jet head mount 100 according to an embodiment of the present general inventive concept and an ink-jet printing apparatus including the same will now be described in detail with reference to the accompanying drawings.

FIG. 1 is a perspective view illustrating the ink-jet printing apparatus according to an embodiment of the present general inventive concept. As illustrated FIG. 1, the ink-jet printing apparatus includes an R-ink-jet head 10 to eject red (R) colored ink, a G-ink-jet head 20 to eject green (G) colored ink, a B-ink-jet head 30 to eject blue (B) colored ink, the ink-jet head mount 100 in which the ink-jet heads 10, 20, and 30 are installed, a frame 200 in which the ink-jet head mount 100 is installed, and a driving part 210 to rotate and linearly move the ink-jet head mount 100 together with the frame 200 in a certain direction about a print substrate. The driving part 210 includes a driving motor (not shown) to rotate the frame 200, which is provided therein and is installed to move in a state of being suspended from a transfer mechanism (not shown).

Figure 2:
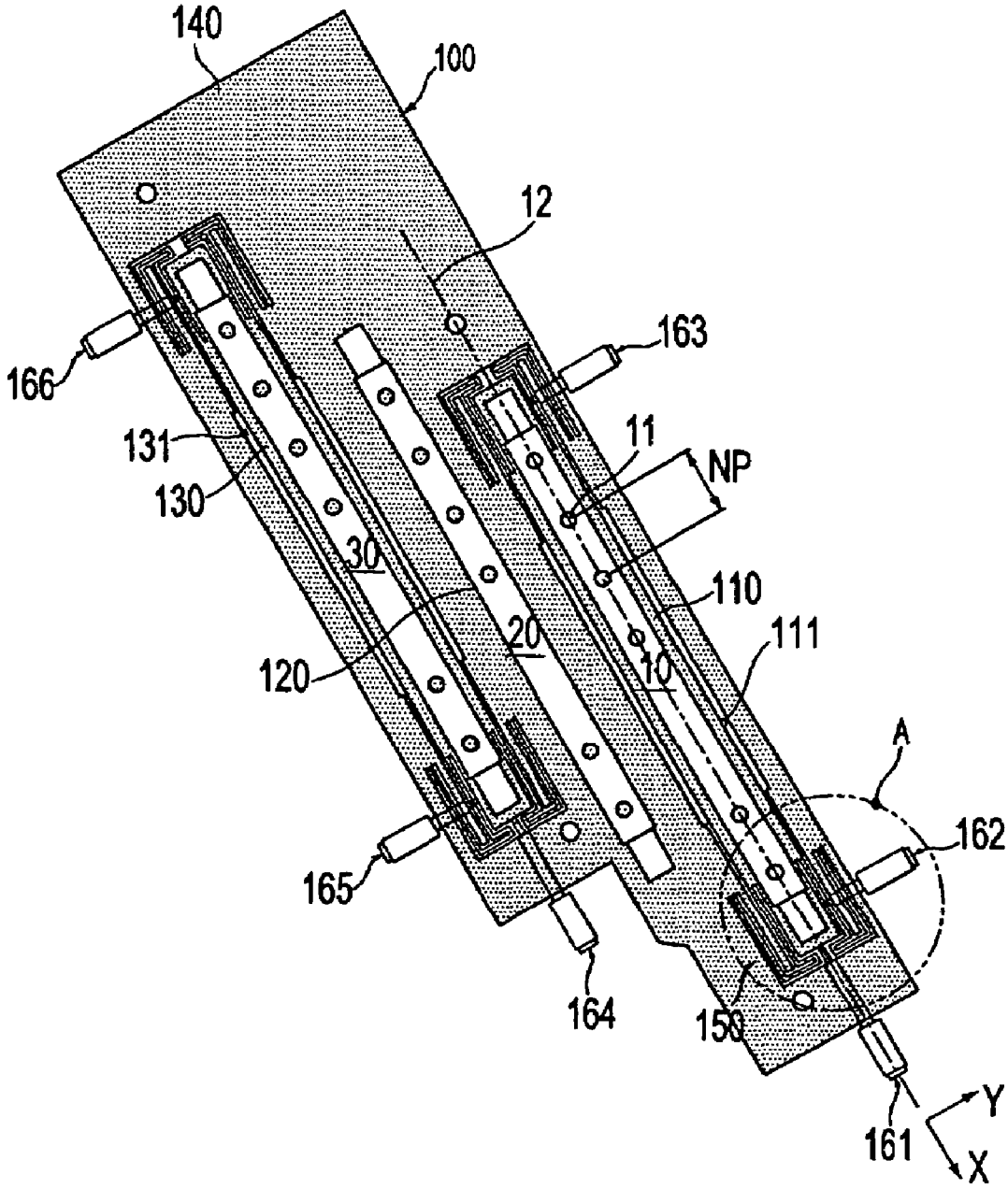
FIG. 2 is a plan view illustrating an ink-jet head mount of the ink-jet printing apparatus of FIG. 1 according to an embodiment of the present general inventive concept.
Figure 3:
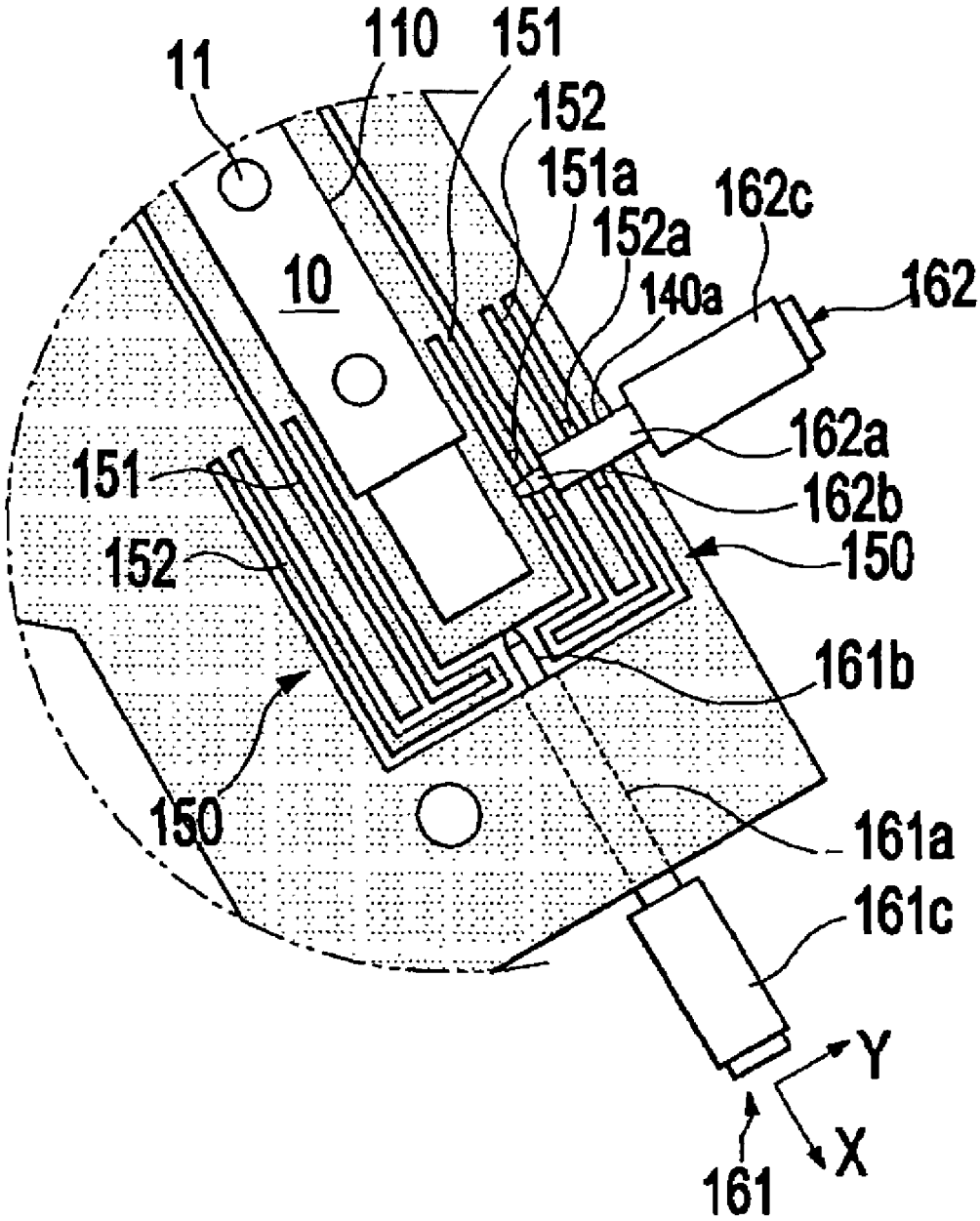
FIG. 3 is an enlarged view illustrating a portion "A" of the ink-jet head mount of FIG. 2.

As illustrated in FIGS. 2 and 3, the R-ink-jet head 10 is formed with a plurality of nozzles 11 arranged in a straight line to form a nozzle line 12 to eject the ink. Other types of nozzle arrangements may also be used with the ink-jet heads of the present general inventive concept. Neighboring nozzles 11 are arranged at regular intervals and a distance between centers of the neighboring nozzles 11 is referred to as a nozzle pitch NR The G-ink-jet head 20 and the B-ink-jet head 30 may have a structure identical to the R-ink-jet head 10. The ink-jet heads 10, 20, and 30 are installed in parallel with respect to each other.

Hereinafter, for illustrative convenience, a coordinate system is defined wherein a lengthwise direction of the ink-jet heads 10, 20, and 30 is set as an X-axis direction and a widthwise direction of the ink-jet heads 10, 20, and 30 is set as a Y-axis direction.

The ink-jet head mount 100 may comprise a steel plate of a predetermined thickness. The ink-jet head mount 100 is provided with an R-ink-jet head installer 110, a G-ink-jet head installer 120, and a B-ink-jet head installer 130 which have a longitudinal hole in which the R-ink-jet head 10, the G-ink-jet head 20, and the B-ink-jet head 30 are installed, respectively. A gap 111 with a width that is less than a few millimeters (mm) is formed around a circumference of the R-ink-jet head installer 110. The gap 111 may be formed, for example, by a wire-cutting process. Thus, the R-ink-jet head installer 110 is spaced apart from a body 140 by the gap 111 to surround the R-ink-jet head installer 110 to secure a space in which the R-ink-jet head installer 110 is minutely movable in the X-axis direction and the Y-axis direction. Similarly, the B-ink-jet head installer 130 also has a gap 131 formed around a circumference thereof to be spaced apart from the body 140. Unlike the R-ink-jet head installer 110 and the B-ink-jet head installer 130, the G-ink-jet head installer 120 is directly provided along the body 140 without a gap formed around a circumference thereof.

As illustrated in FIG. 3, elastic deformation parts 150 to connect the R-ink-jet head installer 110 to the body 140 are provided around four corners of the R-ink-jet head installer 110. The elastic deformation parts 150 include two plate springs 151 and 152, which are bent around the corners of the R-ink-jet head installer 110 and extend in the X-axis direction and in the Y-axis direction, perpendicularly. The plate spring closest to the R-ink-jet head installer 110 is referred to as an inner plate spring 151 and the plate spring farther from the R-ink-jet head installer 110 is referred to as an outer plate spring 152. The plate springs 151 and 152 are connected to each other such that their ends, which extend in the Y-axis direction, are connected to each other. Ends of the inner plate springs 151 that extend in the X-axis direction are connected to the R-ink-jet head installer 110, and ends of the outer plate springs 152 that extend in the X-direction are connected to the body 140. The plate springs 151 and 152 are made by cutting off circumferences thereof in the shape as illustrated in the drawings.

As described above, the elastic deformation parts 150 are provided around four corners of the B-ink-jet head installer 130 and around four corners of the R-ink-jet head installer 110.

The respective head installers 110, 120, and 130, the elastic deformation parts 150, and the body 140 may not be made of a separate material, but may be made of a single metal plate. The single metal plate may be formed by cutting.

Figure 4:
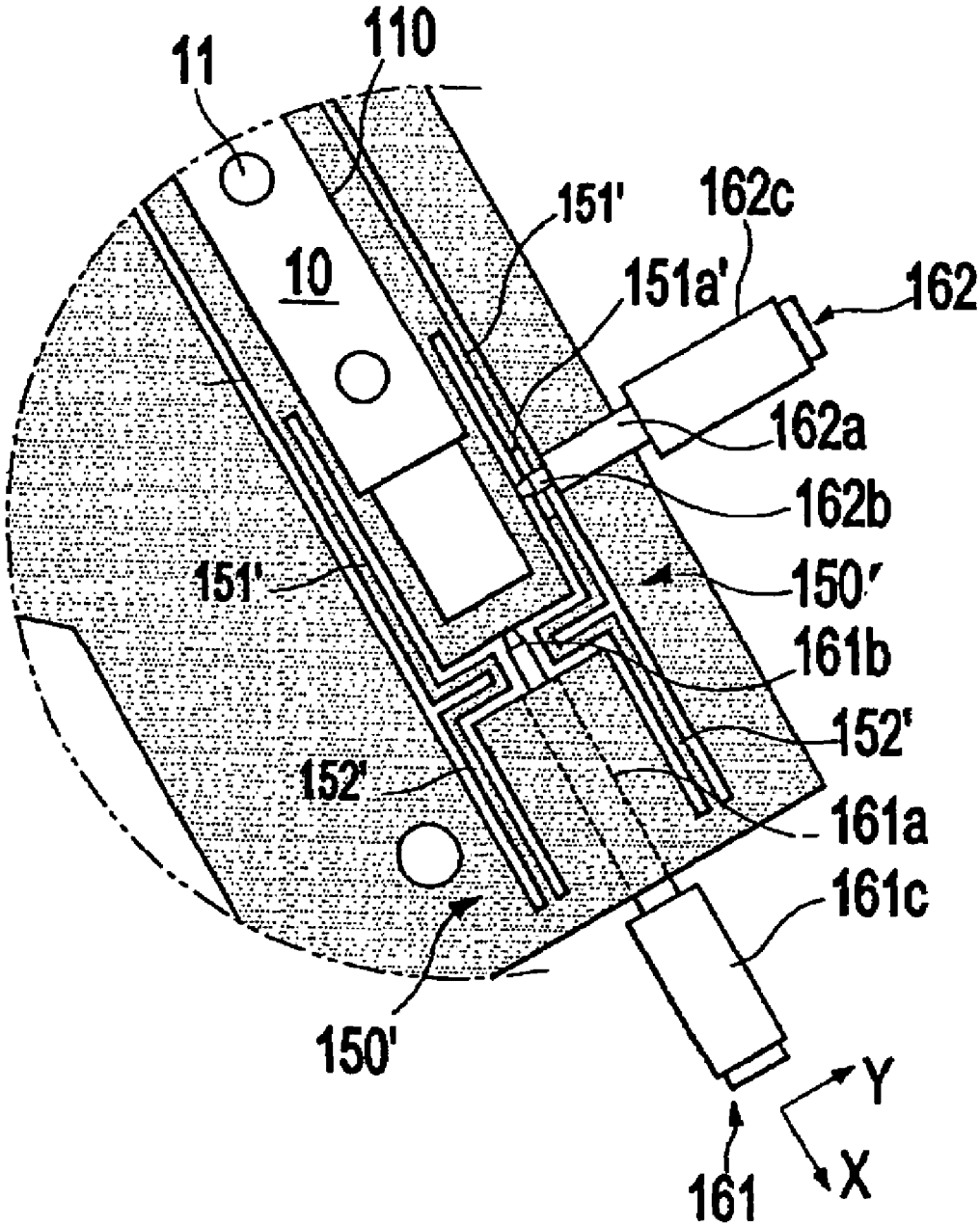
FIG. 4 is a plan view illustrating an ink-jet head mount of the ink-jet printing apparatus of FIG. 1 according to another embodiment of the present general inventive concept.

FIG. 4 illustrates elastic deformation parts 150' of the ink-jet head mount 100 according to another embodiment of the present general inventive concept. The same reference numerals are assigned to components similar to those of FIG. 3. The elastic deformation parts 150' are different from the elastic deformation parts 150 of FIG. 3 in that two plate springs 151' and 152' are symmetrically disposed about the Y-axis direction.

The configuration of the elastic deformation parts 150 and 150' is not limited to the shapes illustrated in FIGS. 3 and 4, and other configurations may also be used for an elastic deformation part.

A first position adjustor 161 to minutely adjust the position of the R-ink-jet head installer 110 by causing an X-axis directional movement of the R-ink-jet head installer 110 is provided at a central portion of a short side of the R-ink-jet head installer 110. Second and third position adjustors 162 and 163 to cause a Y-axis directional movement of the R-ink-jet head installer 110 are provided at both ends of a long side of the R-ink-jet head installer 110. As illustrated in FIG. 3, the first position adjustor 161 may have a structure that is similar to a conventional micrometer and includes a sleeve 161*a* fixed on the body 140 of the ink-jet head mount 100, a spindle 161*b* that is inserted into the central portion of the short side of the R-inkjet head installer 110 in an axial direction to move forward and backward and has an end to contact the short side of the R-ink-jet head installer 110, and a thimble 161*c* to rotate with respect to the sleeve 161*a* and to guide the spindle 161*b* to advance toward the short side of the R-ink-jet head installer 110 and retreat therefrom. As illustrated in FIG. 3, the spindle 161*b* is installed to contact the R-ink-jet head installer 110 at an empty space between the two elastic deformation parts 150.

The second position adjustor 162 includes a sleeve 162*a*, a spindle 162*b*, and a thimble 162*c*, like the first position adjustor 161. The inner and outer plate springs 151 and 152 and the body 140 are provided with holes 140*a*, 151*a*, and 152*a*, respectively, so that the spindle 162*b* of the second position adjustor 162 may be installed therein to contact the R-inkjet head installer 110. The hole 140*a* formed in the body 140 may have the same diameter as an outer diameter of the sleeve 162*a* so as to fix the sleeve 162*a* of the second position adjustor 162 in the hole 140*a*. The holes 151*a* and 152*a* in the inner and outer plates 151 and 152, respectively, may have diameters greater than the outer diameter of the sleeve 162*a* so that the inner and outer plate springs 151 and 152 can move about the second position adjuster 162.

The third position adjustor 163 has the same components and structure as the second position adjustor 162.

Figure 5A:
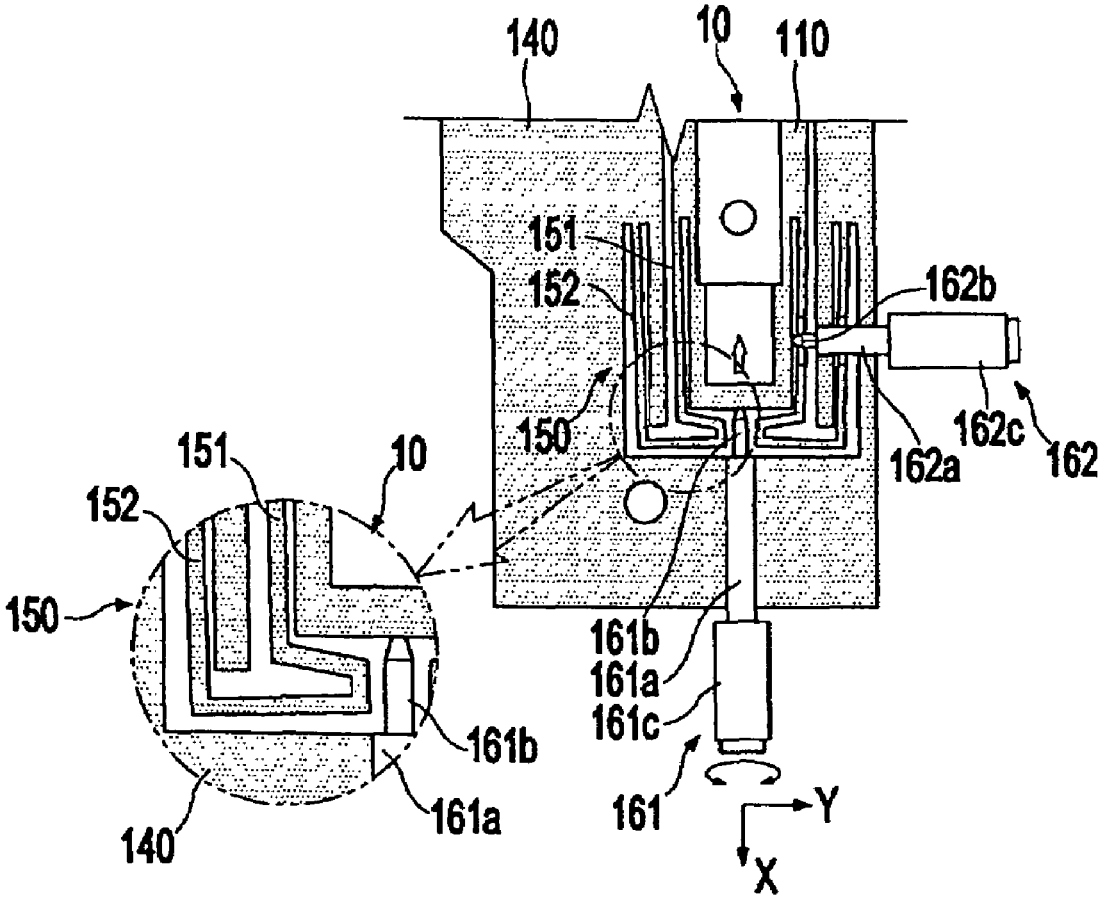
FIGS. 5A and 5B are plan views illustrating operation of the ink-jet head mount of FIG. 2.

FIG. 5A illustrates a minute movement of the R-ink-jet head installer 110 and a deformation of the elastic deformation parts 150 caused by the first position adjustor 161. When the spindle 161*a* advances toward the R-ink-jet head installer 110 by operating the thimble 161*c* of the first position adjustor 161, the spindle 161*a* moves the R-inkjet head installer 110 minutely in a negative X-axis direction. The elastic deformation parts 150 that are connected to the R-ink-jet head installer 110 are deformed to the shape illustrated in FIG. 5A. The deformed elastic deformation parts 150 generate a restoring force to return the R-ink-jet head installer 110 to a neutral position prior to the movement of the R-ink-jet head installer 110. The neutral position may be understood as an initial position of the R-ink-jet head installer 110 prior to movement caused by the first position adjuster 161. Thus, when the spindle 161*a* is moved in a positive X-axis direction (i.e., a reverse direction), the R-ink-jet head installer 110 is minutely moved in the reverse direction by the restoring force of the elastic deformation parts 150.

When the R-ink-jet head installer 110 is at the neutral position and the spindle 161*b* is advanced toward the R-ink-jet head installer 110 (i.e., in the negative X-axis direction), the R-ink-jet head installer 110 is pushed and the elastic deformation parts 150 are deformed to generate the restoring force. The R-ink-jet head installer 110 is returned to the neutral position once the spindle 161*b* is retreated outward (i.e., in the positive X-axis direction). Thus, the position of the R-ink-jet head installer 110 may be shifted from a central region of a minute movement region to outside by a half of entire minute movement region.

Figure 5B:
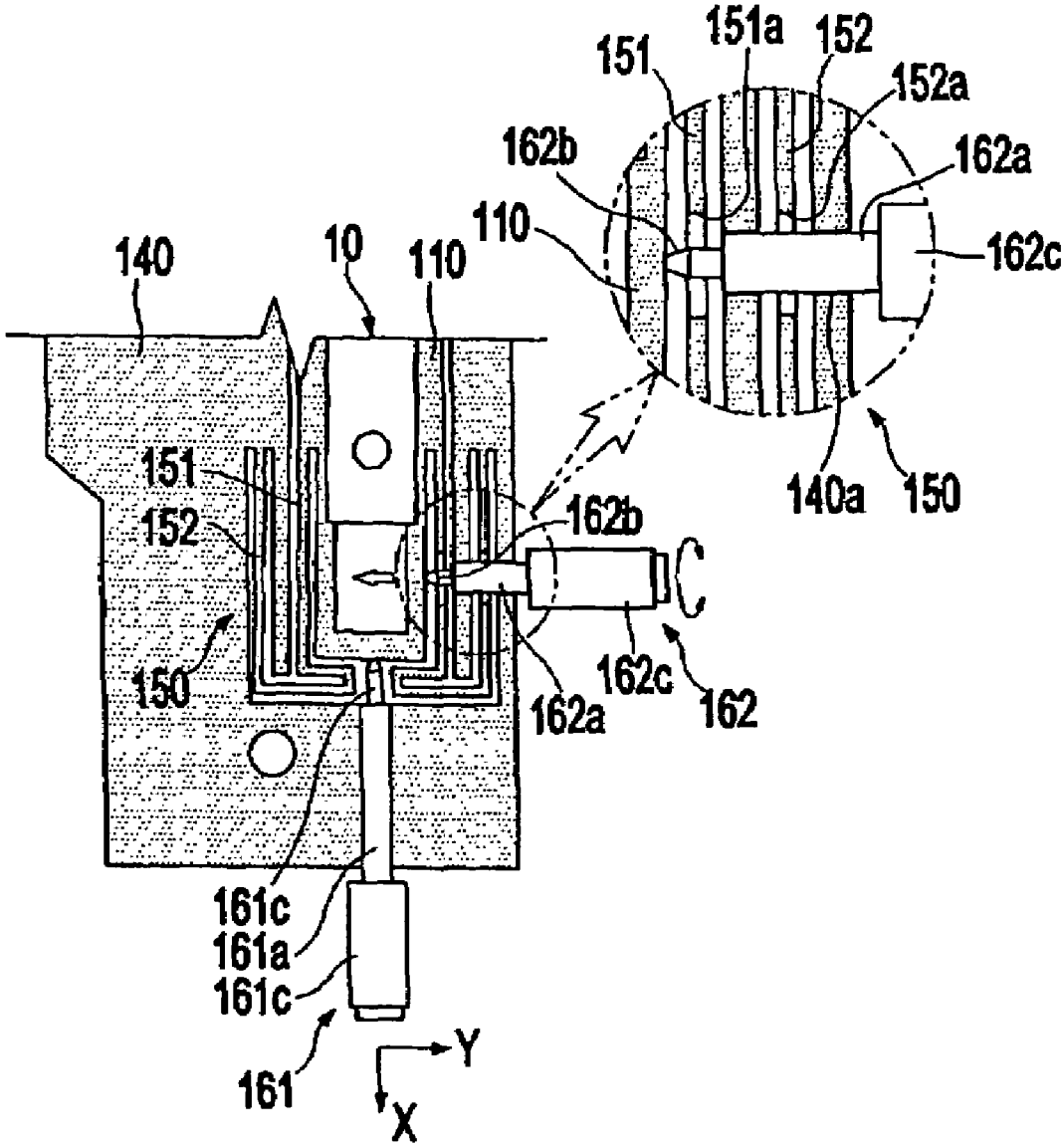

FIG. 5B illustrates the minute movement of the R-ink-jet head installer 110 and the deformation of the elastic deformation parts 150 caused by the second position adjustor 162. Like the operation of the first position adjuster 161 illustrated in FIG. 5A, when the spindle 162*b* of the second position adjustor 162 advances and retreats, an end of the R-ink-jet head installer 110 moves in the Y-axis direction.

Since the minute movement of the R-ink-jet head installer 110 is precisely controlled within a degree of a few tens of nanometers (nm), the minute movement cannot be confirmed with the naked eye. FIGS. 5A and 5B exaggerate the minute movement for illustrative purposes.

Although only the first, second, and third position adjustors 161, 162, and 163 to minutely adjust the position of the R-ink-jet head installer 110 are described, fourth, fifth, and sixth position adjustors 164, 165, and 166 to minutely adjust the position of the B-ink-jet head installer 130 are also provided around the B-ink-jet head installer 130 (See FIG. 2). The fourth position adjustor 164 moves the B-ink-jet head installer 130 minutely in the X-axis direction, and the fifth and sixth position adjustors 165 and 166 move both ends of the B-ink-jet head installer 130 minutely in the Y-axis direction.

Overall operation of the ink-jet printing apparatus according to the present general inventive concept will be described in detail with reference to FIG. 6.

Figure 6:
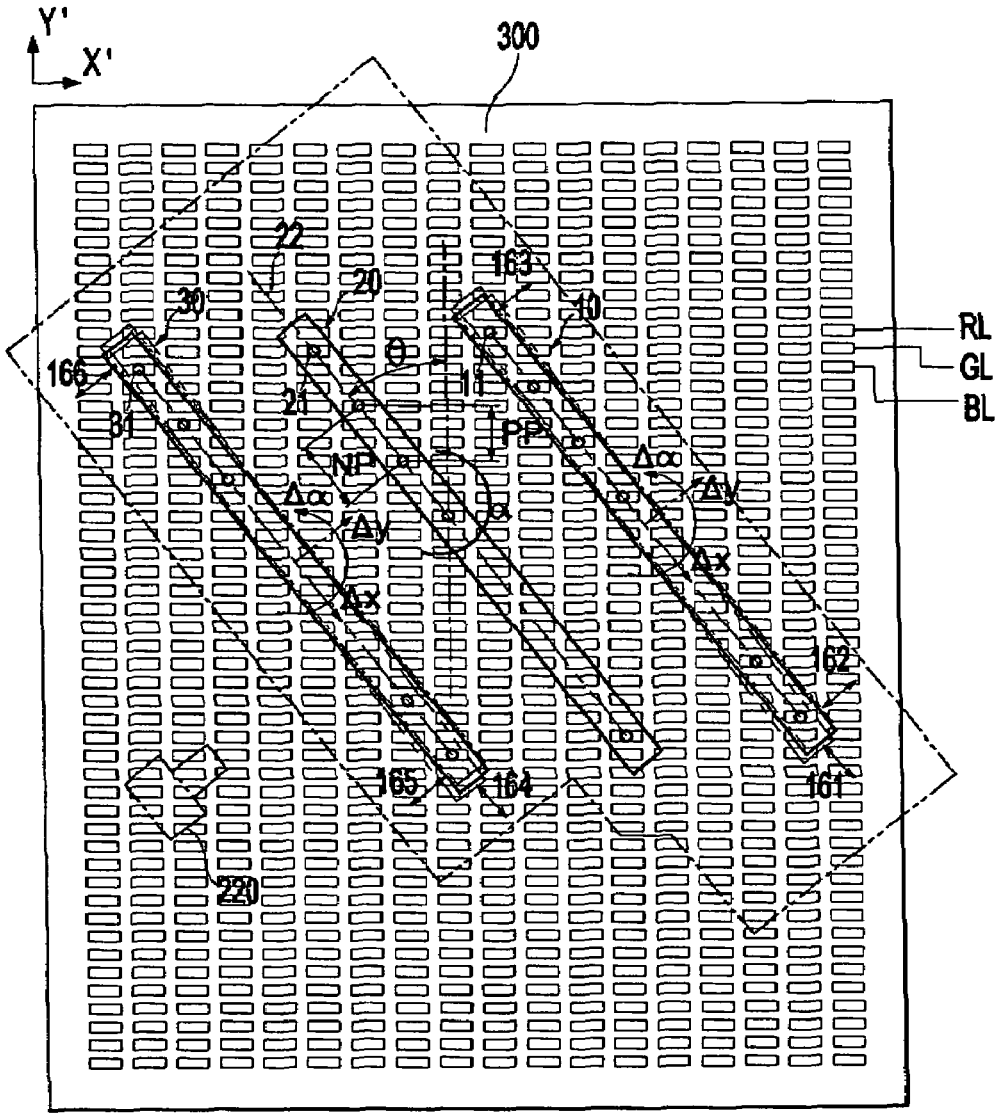
FIG. 6 is a schematic view illustrating operation of the ink-jet printing apparatus of FIG. 1.

As illustrated in FIG. 6, a glass panel 300 to manufacture a TFT-LCD color filter is formed with rows and columns of pixel cavities spaced at regular intervals. Respective cavities should be coated with specific colored ink. R-lines RL should be coated with red colored ink, G-lines GL should be coated with green colored ink, and B-lines BL should be coated with blue colored ink. The R-lines RL, G-lines GL, and B-lines BL are formed repeatedly along the glass panel 300. A vertical distance between pixels to be coated with the same colored ink, for example, a distance from one R-line RL to a next R-line RL becomes a pixel pitch PP. The pixel pitch varies according to different models of color filters.

The glass panel 300 is prepared according to a specific model of the color filter; and the ink-jet printing apparatus is positioned above the glass panel 300 as illustrated in FIG. 6.

By setting the G-ink-jet head 20 among three ink-jet heads 10, 20, and 30 as a reference point, the ink-jet head mount 100 (see, for example, FIG. 1) is arranged on the glass panel 300. Generally, since the nozzle pitch NP (i.e., the gap between the nozzles 21 of the G-ink-jet head 20) is not equal to the pixel pitch PP (i.e., the gap between the pixels on the glass panel 300) the ink-jet head mount 100 should be rotated to form a predetermined angle between the direction of the lines of the pixels and a nozzle line 22 of the G-ink-jet head 20 in order to align the respective nozzles 21 with the respective pixels. As defined in the coordinate system of FIG. 6, a direction of lines formed by the pixels to be coated with same colored ink (i.e., the G-lines GL, R-lines RL, and the B-lines BL) correspond to an X'-axis direction and a direction perpendicular to the X'-axis direction corresponds to a Y'-axis direction. An angle between the nozzle line 22 of the G-ink-jet head 20 and the Y'-axis direction becomes $\theta$=arcos (pixel pitch PP/nozzle pitch NP). The driving part 210 (see FIG. 1) is operated to rotate the ink-jet head mount 100 together with the frame 200 by $\theta$ so as to align the nozzles 21 of the G-ink-jet head 20 with the pixels of the G-lines GL. Linear movement in the X'-axis direction and the Y'-axis direction may also be performed. Since the direction in which the ink-jet printing apparatus is moved is set to the X'-axis direction and the direction in which the glass panel 300 is moved is set to the Y'-axis direction, the glass panel 300 and the ink-jet head mount 100 move in the X'-axis direction and in the Y'-axis direction so that the nozzles 21 of the G-ink-jet head 20 can be aligned with the respective pixels. In other words, as illustrated in FIG. 6, the nozzles 21 of the G-ink-jet head 20 are moved by the driving part 210 so that neighboring nozzles 21 may be aligned with neighboring pixel G-lines GL. When arranging the G-ink-jet head 20, the alignment of the nozzles 21 of the G-ink-jet head 20 with the pixels of the glass panel 300 is observed using a camera 220, with a high magnification lens, provided in the ink-jet printing apparatus.

Once alignment of the nozzles 21 of the G-ink-jet head 20 with the pixels in the G-lines GL is complete, the nozzles 11 and 31 of the R-ink-jet head 10 and the B-ink-jet head 30 may be slightly misaligned with the respective pixels on the glass panel 300 (i.e., the pixels in the R-lines RL and the B-lines BL, respectively). This may occur, because intervals of pixels arranged on the glass panel vary according to the different models of the color filters. The R-ink-jet head 10 and the B-ink-jet head 30 may be minutely moved to compensate for these variations. The camera 220 with high magnification lenses may be used to observe the arrangement of the nozzles 11 of the R-ink-jet head 10 and a degree of misalignment with the respective pixels. Accordingly, a movement of the R-ink-jet head including an X-axis directional movement Ax, a Y-axis directional movement $\Delta y$, and rotation $\Delta\alpha$ on an XY plane may be estimated. The R-ink-jet head 10 is moved by $\Delta x$ in the X-axis direction by the first position adjustor 161. In a similar manner, the R-ink-jet head 10 is moved by $\Delta y$ in the Y-axis direction by the second and third position adjustors 162 and 163. In order to linearly move the R-ink-jet head 10 in the Y-axis direction, both ends of the R-ink-jet head 10 should be moved by the same distance. When both ends of the R-ink-jet head 10 are moved in opposite directions along the Y-axis direction by the second and third position adjustors 162 and 163, the R-ink-jet head 10 is rotated. Opposite directional movement of the second and third position adjusters 162 and 163 can be controlled to rotate the R-ink-jet head 10 by $\Delta\alpha$. The R-ink-jet head 10 moves in the X-axis direction and in the Y-axis direction and rotates on the XY plane. In other words, the R-ink-jet head 10 is movable according to three-degrees-of-freedom and can move in all directions required to move a rigid body on a plane.

As in the above description, the B-ink-jet head 30 can also be aligned with the respective pixels of the glass panel 300 (i.e., consecutive B-lines BL) by the fourth, fifth, and sixth position adjustors 164, 165, and 166 in a similar manner in which the R-ink-jet head 10 is aligned with the respective pixels (i.e., consecutive R-lines RL) by the first, second, and third position adjusters 161, 162, and 163. The B-ink-jet head 30 also moves according to three-degrees-of-freedom.

As described above, according an ink-jet printing apparatus of the present general inventive concept, positions of ink-jet heads may be minutely adjusted according to three-degrees-of-freedom, so that positions of nozzles of the ink-jet heads can be precisely adjusted according to a pixel pitch of a glass panel. It should be understood that the ink-jet printing apparatus of the present general inventive concept can be used with various different types of ink-jet heads including, but not limited to, piezo-electric ink-jet heads, thermal ink-jet heads, top-ejecting ink-jet heads, side-ejecting ink-jet heads, bottom-ejecting ink-jet heads, etc. Additionally, although FIG. 6 illustrates glass panel as a print substrate, other types of print substrates may be used with the present general inventive concept.

Moreover, since respective ink-jet head installers, elastic deformation parts, moving mechanisms of an ink-jet head mount, and a body are integrally formed, driving error that inevitably occurs between mechanical components in conventional ink-jet printing apparatuses, does not occur in the ink-jet printing apparatus of the present general inventive concept. Therefore, it is possible to precisely adjust the position of the ink-jet heads.

Although the preferred embodiments of the general inventive concept have been disclosed for illustrative purposes, those skilled in the art will appreciate that various modifications, additions and substitutions are possible, without departing from the scope and spirit of the general inventive concept as disclosed in the accompanying claims.

What is claimed is:

1. An ink-jet printing apparatus, comprising:

a plurality of ink-jet heads having a plurality of nozzles to eject ink;

an ink-jet head mount in which the plurality of ink-jet heads are installed such that one of the plurality of ink-jet heads is fixed to the ink-jet head mount as a reference ink-jet head, and relative positions of remaining ink-jet heads are adjustable with respect to the reference ink-jet head; and a frame in which the ink-jet head mount is installed, wherein the ink-jet head mount comprises:

a first ink-jet head installer, a second ink-jet head installer, and a third ink-jet head installer in which the first, second, and third ink-jet heads are respectively installed;

a first position adjustor to move the first ink-jet head installer in a lengthwise direction thereof;

a second position adjustor and a third position adjustor to move both ends of the first ink-jet head installer in a widthwise direction of the first ink-jet head installer;

a fourth position adjustor to move the third ink-jet head installer in a lengthwise direction thereof; and a fifth position adjustor and a sixth position adjustor to move both ends of the third ink-jet head installer in a widthwise direction of the third ink-jet head installer.

2. The ink-jet printing apparatus as set forth in claim 1, wherein the remaining ink-jet heads are movable according to three-degrees-of-freedom.

3. An ink-jet printing apparatus, comprising:

a first ink-jet head, a second ink-jet head, and a third ink-jet head to eject red colored ink, green colored ink, and blue colored ink without overlapping;

an ink-jet head mount in which two ink-jet heads are installed to be minutely controlled according to three-degrees-of-freedom with respect to one ink-jet head fixed to the ink-jet head mount as a reference point among the first, second, and third ink-jet heads;

a frame in which the ink-jet head mount is installed; and a driving part to move the frame, wherein the ink-jet head mount comprises:

a first ink-jet head installer, a second ink-jet head installer, and a third ink-jet head installer in which the first, second, and third ink-jet heads are respectively installed;

a first position adjustor to move the first ink-jet head installer in a lengthwise direction thereof;

a second position adjustor and a third position adjustor to move both ends of the first ink-jet head installer in a widthwise direction of the first ink-jet head installer;

a fourth position adjustor to move the third ink-jet head installer in a lengthwise direction thereof; and a fifth position adjustor and a sixth position adjustor to move both ends of the third ink-jet head installer in a widthwise direction of the third ink-jet head installer.

4. The ink-jet printing apparatus as set forth in claim 3, wherein the first, second, and third ink-jet heads are installed in parallel, and the first and third ink-jet heads are installed in the ink-jet head mount on opposite sides of the second ink-jet head to be movable with respect to the second ink-jet head.

5. The ink-jet printing apparatus as set forth in claim 4, wherein the ink-jet head mount further comprises:

a body to surround the first, second, and third ink-jet head installers.

6. The ink-jet printing apparatus as set forth in claim 5, wherein a gap is formed around the first and third ink-jet head installers so as to separate the first and third ink-jet head installers from the body by a predetermined distance.

7. The ink-jet printing apparatus as set forth in claim 6, wherein the first, second, and third installers comprise longitudinal holes disposed in the body, and the gap comprises:

a first gap disposed in the body to surround a perimeter of the first installer so that the first installer is movable within the body; and a second gap disposed in the body to surround a perimeter of the third installer so that the third installer is movable within the body.

8. The ink-jet printing apparatus as set forth in claim 6, wherein the ink-jet head mount further comprises an elastic deformation part to connect the first ink-jet head installer and the third ink-jet head installer to the body and to generate a restoring force when the first and third ink-jet heads are minutely moved.

9. The ink-jet printing apparatus as set forth in claim 8, wherein the elastic deformation part comprises a plate spring.

10. The ink-jet printing apparatus as set forth in claim 9, wherein the elastic deformation part is provided around corners of the first and third ink-jet head installers.

11. The ink-jet printing apparatus as set forth in claim 9, wherein the first, second, and third ink-jet head installers, the body, and the elastic deformation part are integrally formed with each other.

12. The ink-jet printing apparatus as set forth in claim 3, wherein the driving part rotates and linearly moves the frame in one or more directions about a print substrate.

13. The ink-jet printing apparatus as set forth in claim 3, wherein the reference point ink-jet head is disposed by the ink-jet head mount above a print substrate at a first predetermined location on a print substrate, and remaining ink-jet heads of the first, second, and third ink jet heads are moved within the ink-jet head mount relative to the reference point ink-jet head above the print substrate to at least a second predetermined location of the print substrate.

14. An ink-jet printing apparatus, comprising:

an ink-jet head installer in which an ink-jet head is installed, including a first ink-jet head installer, a second ink-jet head installer, and a third ink-jet head installer in which the first, second, and third ink-jet heads are respectively installed;

a body spaced apart from the ink-jet head such that the ink-jet head installer is minutely movable within the body; and an elastic deformation part to connect the ink-jet head installer to the body and to generate a restoring force when the ink-jet head installer is moved, and includes a gap formed on the ink-jet head installer to surround a portion of the ink-jet head, a first ink-jet head installer, a second ink-jet head installer, and a third ink-jet head installer in which the first, second, and third ink-jet heads are respectively installed;

a first position adjustor to move the first ink-jet head installer in a lengthwise direction thereof;

a second position adjustor and a third position adjustor to move both ends of the first ink-jet head installer in a widthwise direction of the first ink-jet head installer;

a fourth position adjustor to move the third ink-jet head installer in a lengthwise direction thereof; and a fifth position adjustor and a sixth position adjustor to move both ends of the third ink-jet head installer in a widthwise direction of the third ink-jet head installer.

15. The ink-jet printing apparatus as set forth in claim 14, wherein the ink-jet head installer is installed to be movable according to three-degrees-of-freedom.

16. The ink-jet printing apparatus as set forth in claim 14, wherein the ink-jet head installer is integrally formed with the body and the elastic deformation part.

* * * * *